US012653316B2

(12) United States Patent
Davis

(10) Patent No.: US 12,653,316 B2
(45) Date of Patent: Jun. 16, 2026

(54) DUAL FLEX FOOTREST FOR INCREASING CIRCULATION

(71) Applicant: George Davis, Valencia, CA (US)

(72) Inventor: George Davis, Valencia, CA (US)

( * ) Notice: Subject to any disclaimer, the term of this patent is extended or adjusted under 35 U.S.C. 154(b) by 116 days.

(21) Appl. No.: 18/662,755

(22) Filed: May 13, 2024

(65) Prior Publication Data

US 2024/0374040 A1 Nov. 14, 2024

Related U.S. Application Data

(60) Provisional application No. 63/466,039, filed on May 12, 2023.

(51) Int. Cl.

| | |
|---|---|
| ***A47C 16/02*** | (2006.01) |
| ***A63B 21/00*** | (2006.01) |
| ***A63B 21/05*** | (2006.01) |
| *A63B 71/00* | (2006.01) |

(52) U.S. Cl.

CPC ..... *A47C 16/025* (2013.01); *A63B 21/05* (2013.01); *A63B 21/4034* (2015.10); *A63B 2071/0063* (2013.01)

(58) Field of Classification Search

CPC ... A47C 16/025; A47C 16/02; A63B 21/4034; A63B 21/00189; A63B 21/028; A63B 21/4033; A63B 21/05; A63B 22/0056; A63B 23/085; A63B 2071/0063

See application file for complete search history.

(56) References Cited

U.S. PATENT DOCUMENTS

| | | | | | |
|---|---|---|---|---|---|
| 107,869 | A | * | 10/1870 | Burnell | A47C 16/025 248/598 |
| 1,362,692 | A | * | 12/1920 | Goldstein | A47C 16/025 248/600 |
| 3,520,572 | A | * | 7/1970 | Flaugh | A47C 16/025 297/461 |
| 3,641,601 | A | * | 2/1972 | Sieg | A63B 21/055 482/121 |
| 3,741,540 | A | * | 6/1973 | Shimizu | A63B 22/0056 482/80 |
| 3,785,702 | A | * | 1/1974 | Buehring | A47C 16/02 297/423.41 |
| 4,111,416 | A | * | 9/1978 | Jinotti | A63B 21/1672 482/80 |
| 4,279,415 | A | * | 7/1981 | Katz | A63B 69/0035 482/80 |
| 5,028,024 | A | * | 7/1991 | Welles | A47K 17/028 248/163.1 |
| 5,186,700 | A | * | 2/1993 | Wang | A63B 22/0056 482/80 |

(Continued)

FOREIGN PATENT DOCUMENTS

KR 20130034138 A * 4/2013 ..... A63B 21/00069

*Primary Examiner* — William L Miller

(74) *Attorney, Agent, or Firm* — Pacifica IP

(57) ABSTRACT

A dual flex footrest having separate elongated upper portions connected to elongated bottom portions via flexing portions, allowing a user to flex each foot individually to increase circulation to the user's body. The footrest aids in reducing leg swelling, leg cramps, restless leg syndrome, complications from arthritis and diabetes, neuropath, nerve pain and knee and foot pain. The footrest also aids in increasing oxygenated blood rich in nutrients, alertness, creativity, and productivity.

3 Claims, 8 Drawing Sheets

(56) References Cited

U.S. PATENT DOCUMENTS 5,232,419 A * 8/1993 Kozak ..... A63B 69/0035 482/52
5,232,420 A * 8/1993 Terauds ..... A63B 22/0056 482/79
5,256,118 A * 10/1993 Chen ..... A63B 22/0056 482/80
5,267,923 A * 12/1993 Piaget ..... A63B 21/0085 482/52
5,346,444 A * 9/1994 Hsieh ..... A63B 21/0085 482/53
5,544,941 A * 8/1996 Campbell ..... A47C 16/025 297/463.1
5,765,921 A * 6/1998 Chuang ..... A47C 16/025 297/423.46
D397,746 S * 9/1998 Drach ..... D21/668
6,572,514 B1 * 6/2003 Calafato ..... A63B 22/16 482/79
6,631,524 B1 * 10/2003 Dixon ..... A47K 17/028 297/423.45
6,705,975 B2 * 3/2004 Kuo ..... A63B 23/0429 482/52
6,709,368 B1 * 3/2004 Chue ..... A63B 21/015 482/52
6,796,928 B1 * 9/2004 Christopher ..... A63B 22/0056 482/52
7,322,949 B2 * 1/2008 Shimizu ..... A61H 23/02 601/90
7,669,934 B1 3/2010 Cline
7,771,327 B1 * 8/2010 Reams ..... A63B 21/4034 482/80
D629,852 S * 12/2010 Repac ..... D21/662
8,029,420 B1 * 10/2011 Thati ..... A63B 22/0056 482/79
8,715,141 B2 * 5/2014 Bes ..... A63B 21/026 482/52
D795,364 S * 8/2017 Chang ..... D21/692
10,010,228 B2 * 7/2018 Rane ..... A47K 17/028
10,433,643 B2 * 10/2019 Djankovich ..... A47C 20/027
11,089,875 B2 * 8/2021 Djankovich ..... A47C 3/02
11,730,271 B2 * 8/2023 Djankovich ..... A63B 21/00 297/301.1
D1,002,208 S * 10/2023 Davis ..... D6/349
2003/0071508 A1 * 4/2003 Lu ..... A47C 16/025 297/423.43
2003/0092538 A1 * 5/2003 Kuo ..... A63B 22/0056 482/79
2004/0048721 A1 * 3/2004 Chou ..... A63B 22/0056 482/52
2005/0081493 A1 * 4/2005 Chang ..... B68C 3/00 54/48
2009/0163325 A1 * 6/2009 Piaget ..... A63B 22/0056 482/53
2010/0133890 A1 * 6/2010 Port ..... A47C 16/025 297/423.46
2013/0231221 A1 * 9/2013 Rajan ..... A63B 23/08 482/80
2013/0345028 A1 * 12/2013 Bes ..... A63B 22/0056 482/79
2013/0345033 A1 * 12/2013 Peck ..... A63B 21/0618 482/142
2015/0038885 A1 * 2/2015 Zhao ..... A61N 1/18 601/22
2016/0360937 A1 * 12/2016 Naik ..... A47C 16/025
2018/0207467 A1 * 7/2018 Shimizu ..... A61H 1/0266
2018/0221704 A1 * 8/2018 Markus ..... A63B 21/00047
2020/0086172 A1 * 3/2020 Tarkington ..... A63B 21/022

* cited by examiner

DUAL FLEX FOOTREST FOR INCREASING CIRCULATION

CROSS-REFERENCE TO RELATED APPLICATIONS

This application claims priority to U.S. Provisional Patent Application No. 63/466,039 filed May 12, 2023, which is related to U.S. Design patent application Ser. No. 29/815,140, filed Nov. 11, 2021, now U.S. Design U.S. Pat. No. 1,002,208, issued Oct. 24, 2023, which is herein incorporated by reference.

BACKGROUND OF THE INVENTION

1. Field of the Invention

The present invention relates to a footrest, and particularly to a dual flex footrest for increasing circulation.

2. Description of the Related Art

While footrests are known in the art, typical footrests simply provide support for a user's feet, without further health benefits. Increased circulation is understood to be beneficial not only for the heart, but also for the entire body. Accordingly, there is a need for a footrest to increase circulation and overall health.

SUMMARY OF THE INVENTION

A dual flex footrest for increasing circulation is disclosed. The footrest has elongated right and left bottom portions configured to be placed on a flat surface. Right and left bottom portions are connected by a middle connecting portion. Elongated right and left upper portions are connected to the elongated right and left bottom portions, respectively, via right and left flexing portions. A shock absorber is formed between each set of upper and bottom portions.

A user, while seated, can place his/her feet on each of the right and left upper portions to move and/or flex the right and left upper portions relative to the right and left bottom portions to contract and stretch the user's Achilles tendon and/or calves, thereby increasing circulation to the user. The footrest is designed to provide resistance against the user's feet such that the user needs to apply a certain amount of force to flex the right and left upper portions. Shock absorbers are positioned between the right and left upper and lower portions to allow the footrest to be flexed a certain amount providing optimal stretching of the Achilles tendon and/or calves. The shock absorber also prevents the upper portions from bending or breaking after long-term use.

Use of the footrest targets the calf muscles of the user and increases overall circulation to the user. The user can use the footrest while seated, which is not possible with other types of apparatuses that are designed for when a user is standing.

The footrest may assist in reducing the following:

Leg swelling
Leg cramps
Restless leg syndrome
Complications from arthritis & diabetes
Neuropath
Nerve pain
Knee and foot pain The footrest may assist in increasing:

Oxygenated blood rich in nutrients

Alertness and creativity
Productivity

These and other features of the present invention will become readily apparent upon further review of the following specification and claims.

DETAILED DESCRIPTION OF THE FIGURES

Figure 1:
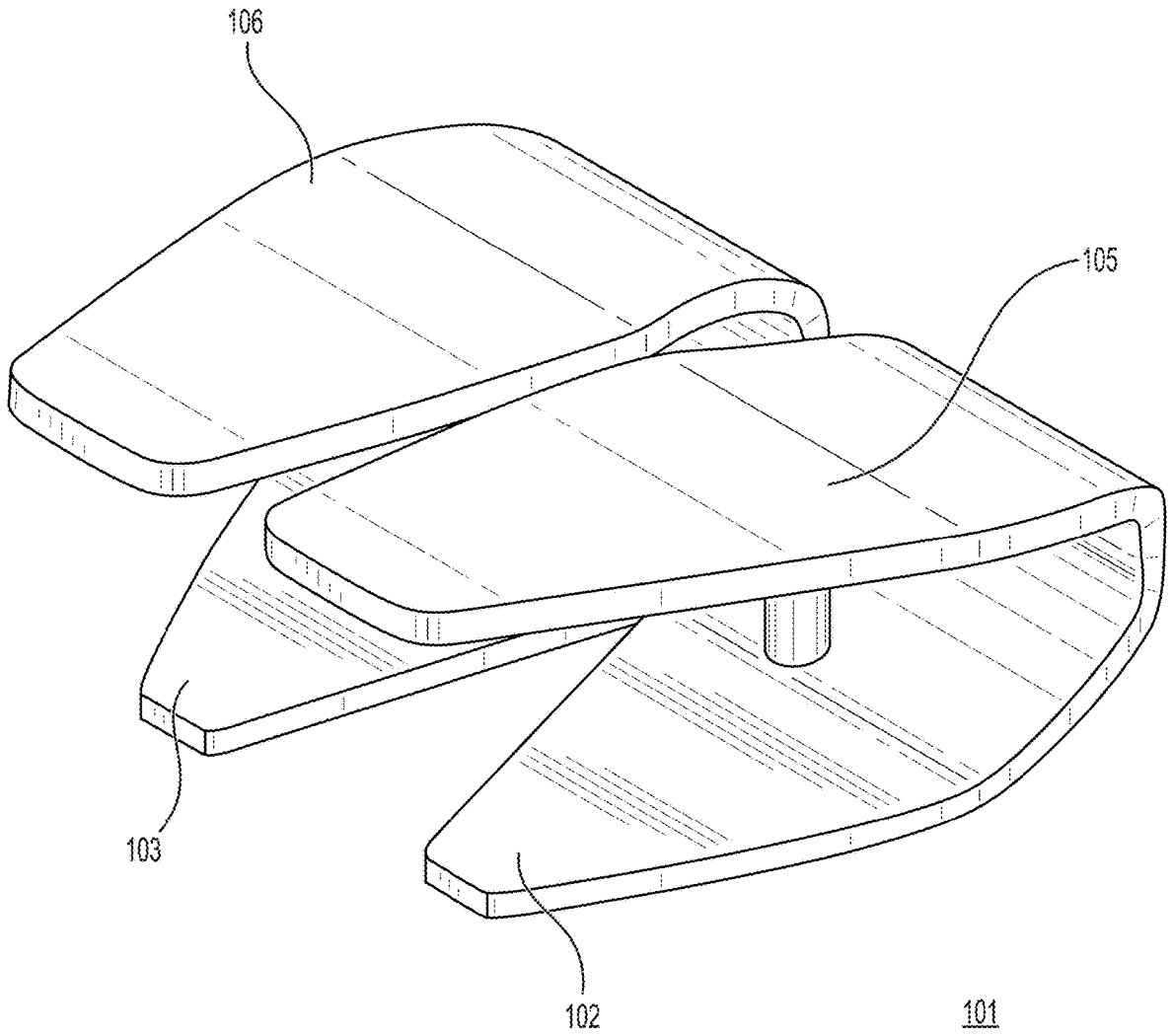
FIG. 1 shows a rear perspective view of the dual flex footrest.
Figure 2:
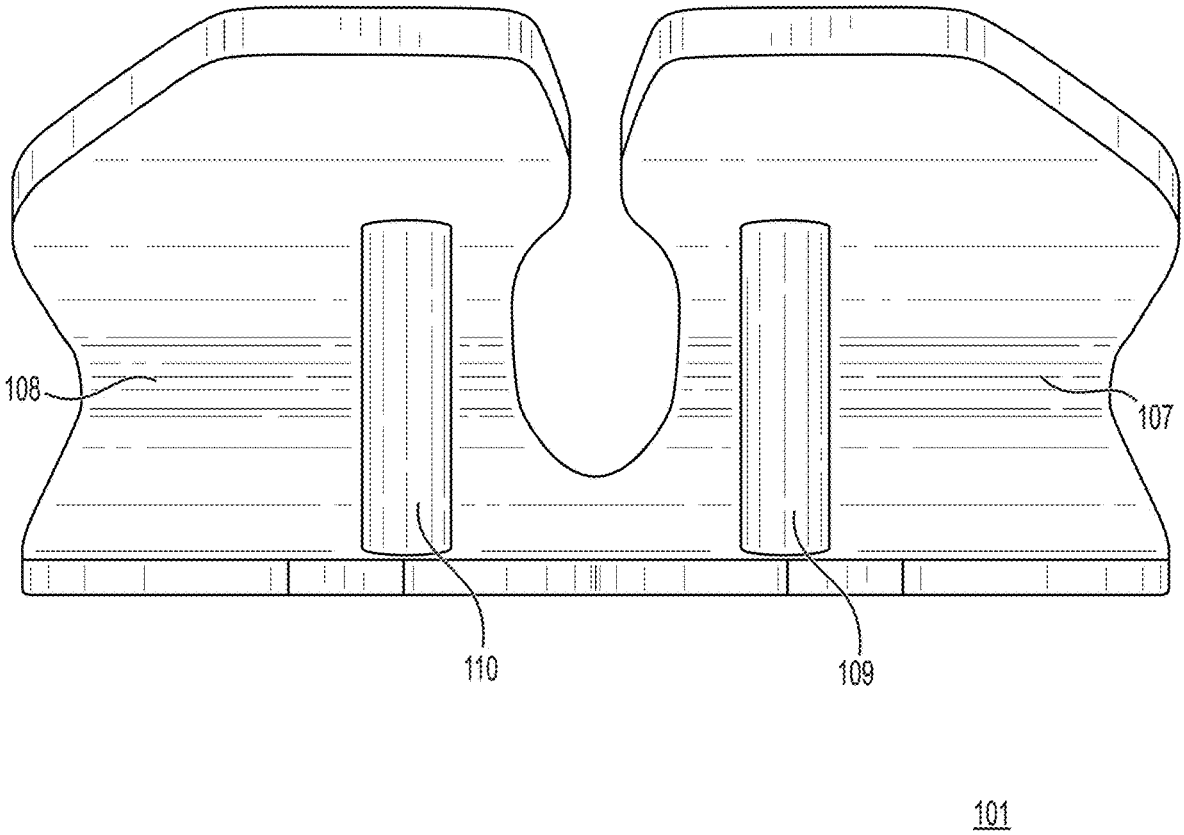
FIG. 2 shows a rear view of the footrest of FIG. 1.
Figure 3:
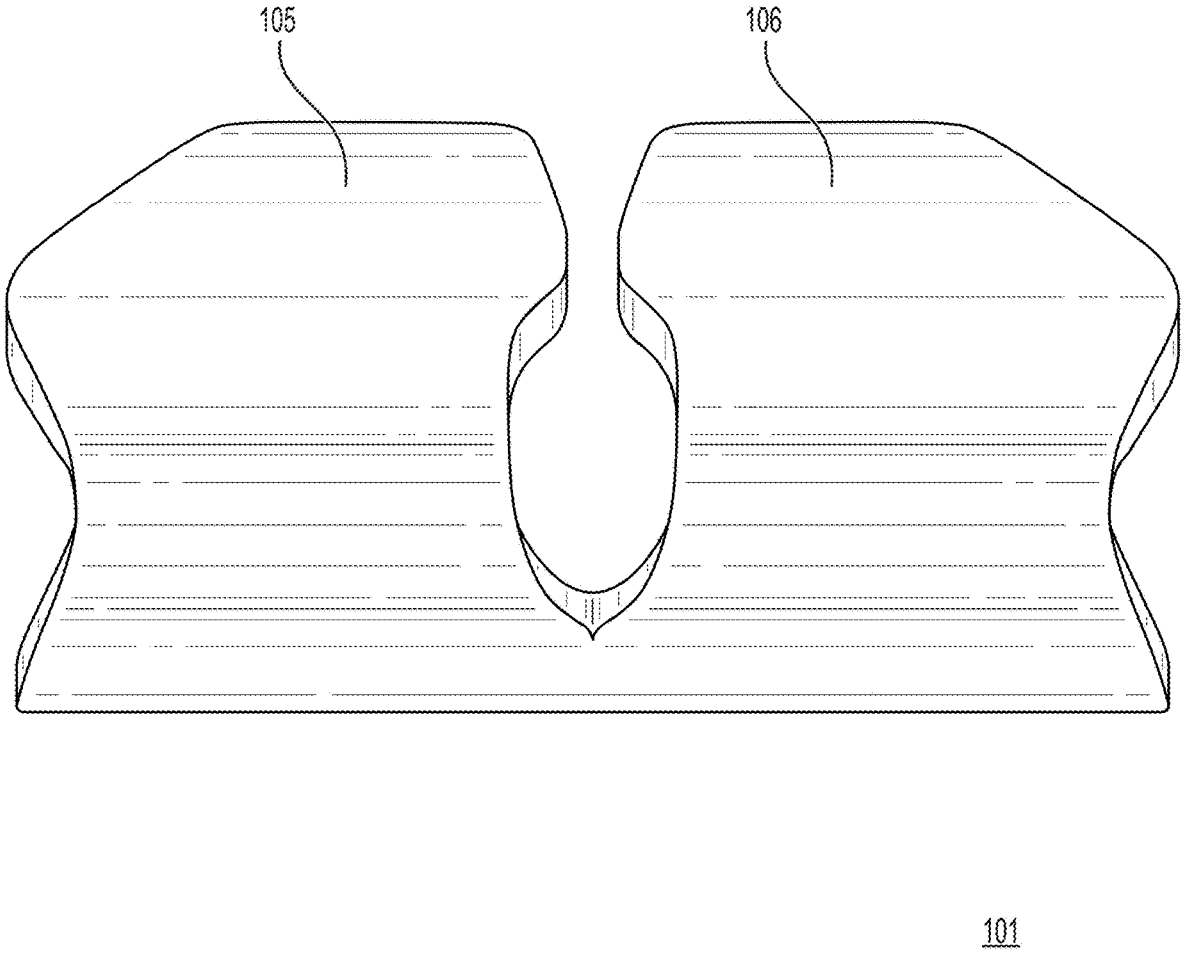
FIG. 3 shows a front view of the footrest of FIG. 1.
Figure 4:
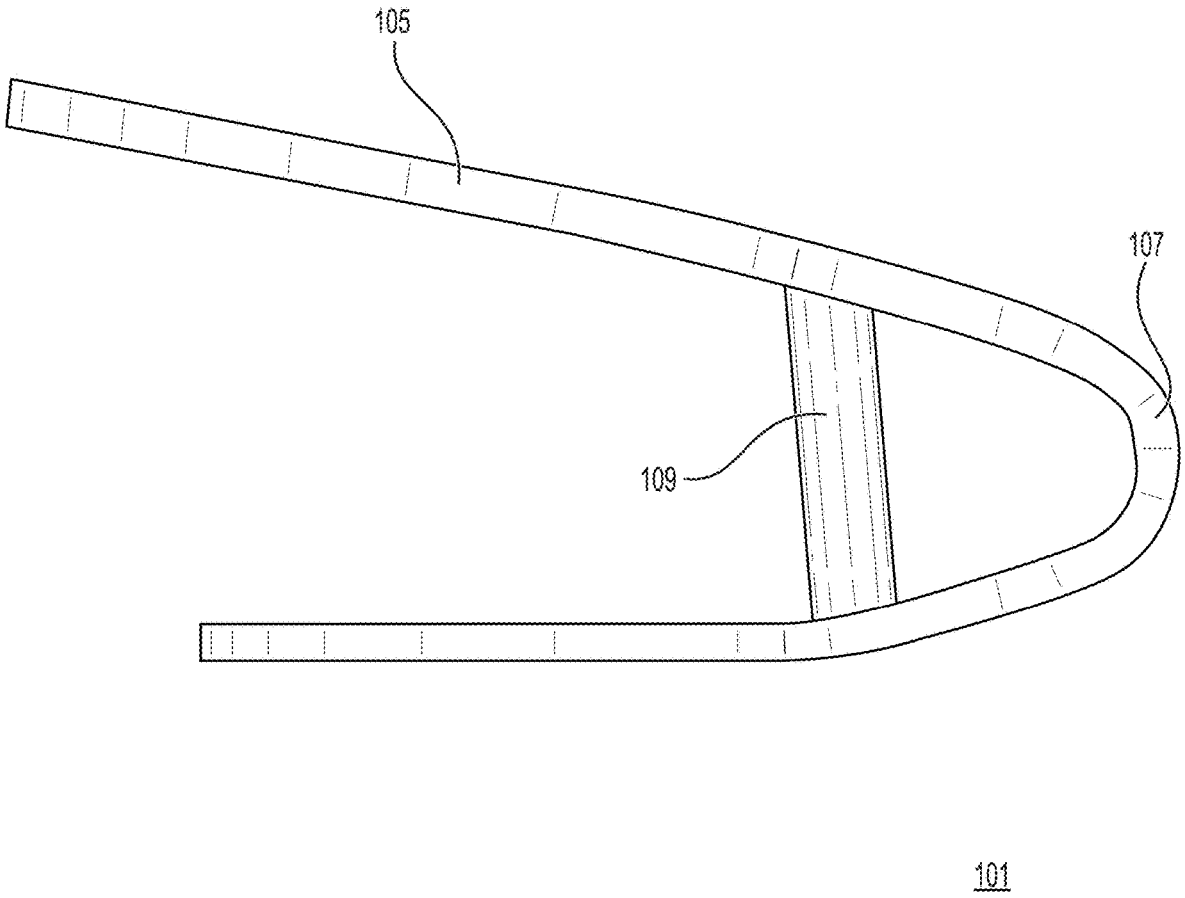
FIG. 4 shows a right side view of a footrest of FIG. 1.
Figure 5:
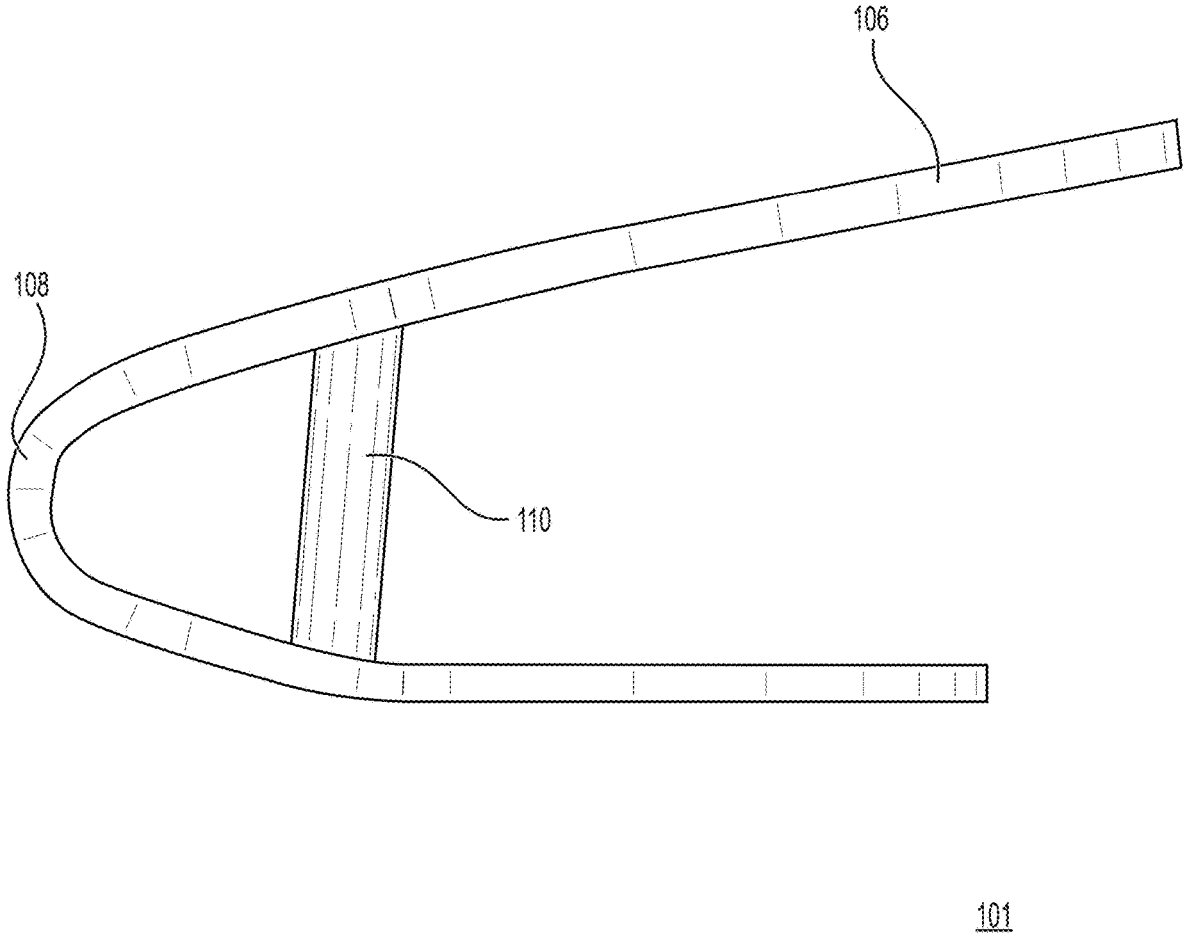
FIG. 5 shows a left side view of the footrest of FIG. 1.
Figure 6:
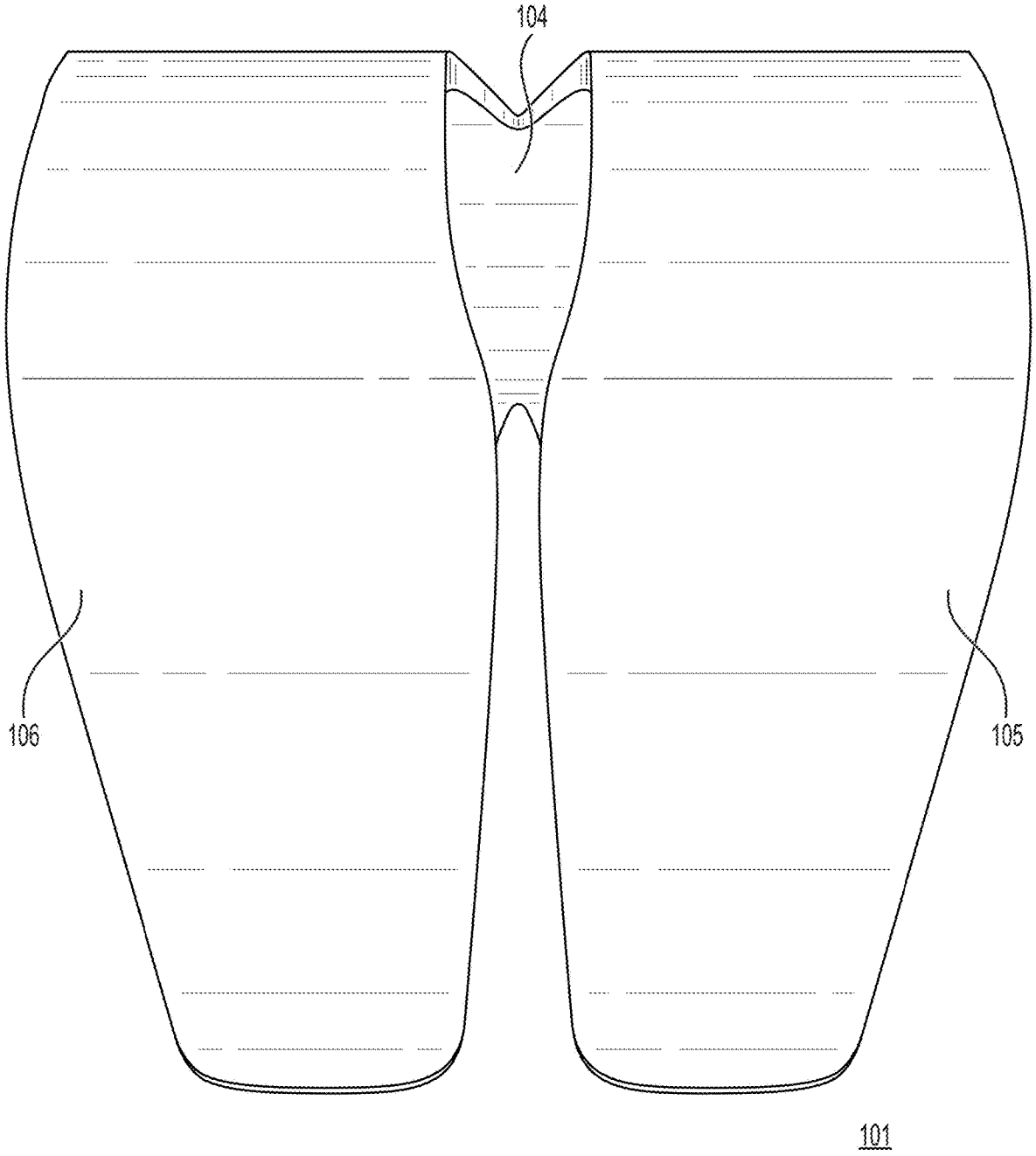
FIG. 6 shows a top plan view of the footrest of FIG. 1.
Figure 7:
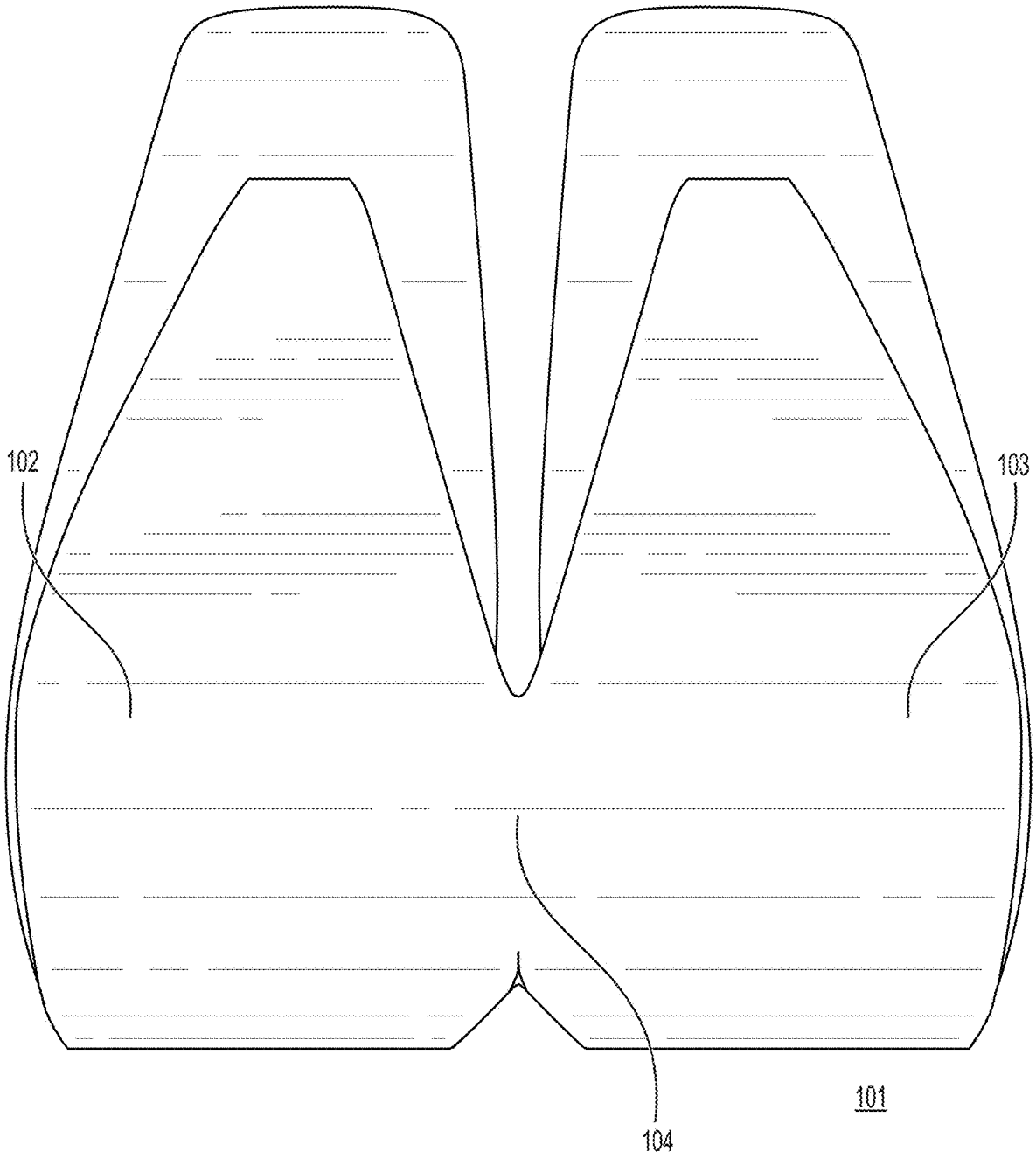
FIG. 7 shows a bottom plan view of a footrest of FIG. 1.

Turning now to the FIGS. 1-7, footrest 101 is shown. Footrest 101 has elongated right and left bottom portions 102 and 103 and are configured to rest on a floor or other suitable surface. Right and left bottom portions 102 and 103 are connected by a middle connecting portion 104. Right and left upper portions 105 and 106 are connected to right and left lower portions 102 and 103, respectively, via right and left flexing portions 107 and 108, respectively.

Provided between the upper and lower portions 105 and 106 are shock absorbers 109 and 110. Shock absorbers 109 and 110 are positioned such that the upper portions 105 and 106 can be flexed a certain amount to optimize stretching of the calf muscles to increase circulation. In one embodiment, the shock absorbers are 1¼ inch round rubber and 2½ inches in height.

Figure 8:
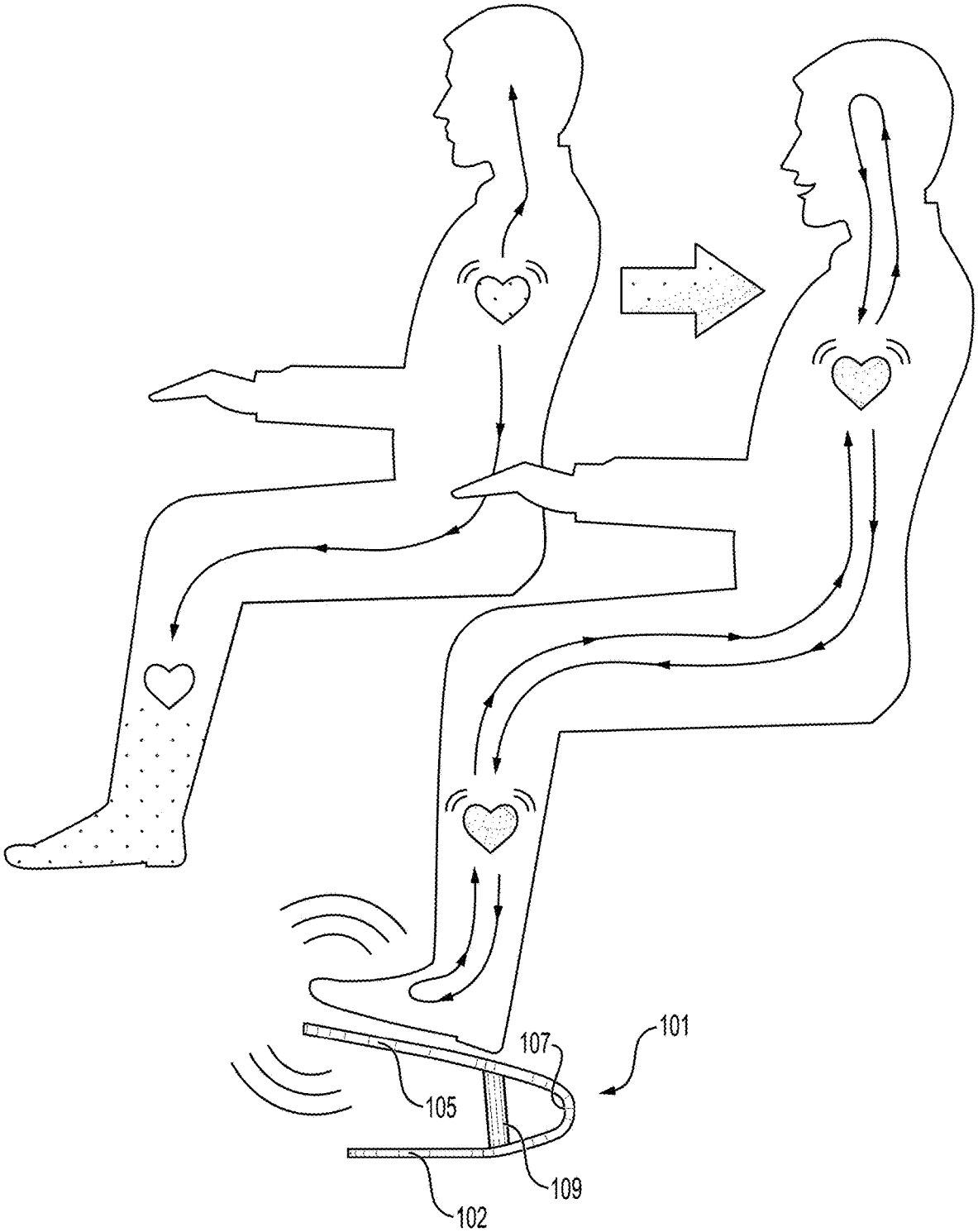
FIG. 8 shows a user using the footrest and a representation of increased circulation in the user's body.

Turning to FIG. 8, the configuration of the footrest allows the footrest to be used while a user is seated. In use, a seated user places his or her feet on each of right and left upper portions 105 and 106 and flexes his/her feet against the right and left upper portion, i.e, pointing and flexing his/her feet. The footrest, along with shock absorbers 109 and 110, provides resistance against the user's feet in both directions, i.e., during extension and flexion to increase circulation to the user's entire body.

The elongated right and left bottom portions 102 and 103, middle connecting portion 104, the elongated right and left upper portions 105 and 106, and right and left flexing portions 107 and 108 can be formed from a unitary piece of aluminum, simplifying manufacturing and assembly.

The footrest can be made of a variety of materials other including, but not limited to, steel or plastic. The material should be able to flex and provide resistance to a user without breaking but also be able to return to its original position. The shock absorber can be made of solid rubber or other suitable material.

It is understood that the present invention is not limited to the embodiments described above but encompasses any and all embodiments with the scope of the appended claims.

The invention claimed is:

1. A dual flex footrest comprising:

an elongated right bottom portion configured to be placed on a flat surface;

an elongated left bottom portion configured to be placed on the flat surface;

said elongated right and left bottom portions connected near proximal ends thereof by a middle connecting portion, wherein distal free ends of said elongated right and left bottom portions are separated from each other;

an elongated right upper portion directly connected to said proximal end of said elongated right bottom portion via a right flexing portion;

an elongated left upper portion directly connected to said proximal end of said elongated left bottom portion via a left flexing portion;

wherein said elongated right and left upper portions can move independently of each other; and shock absorbers provided extending between each of said elongated upper portions and bottom portions and positioned in a rear half of said elongated right and left bottom portions, wherein said rear half includes said proximal ends;

wherein a user, while seated, can place his or her feet on each of said elongated right and left upper portions and move said elongated right and left upper portions relative to said elongated right and left bottom portions; and wherein distal free ends of said elongated right and left upper portions extend in a length direction thereof beyond said distal free ends of said elongated right and left bottom portions, respectively.

2. The dual flex footrest of claim 1, wherein said elongated right and left bottom portions, said middle connecting portion, and said elongated right and left upper portions are a unitary piece.

3. The dual flex footrest of claim 1, wherein said elongated right and left bottom portions, said middle connecting portion, and said elongated right and left upper portions are formed of a unitary piece of aluminum.

* * * * *